United States Patent [19]

Methven

[11] Patent Number: 4,516,516

[45] Date of Patent: May 14, 1985

[54] BALLAST APPARATUS FOR RIGHTING A CAPSIZED BOAT

[76] Inventor: Robert W. Methven, 2991 S. Ivory Ct., Aurora, Colo. 80013

[21] Appl. No.: 547,332

[22] Filed: Oct. 31, 1983

[51] Int. Cl.[3] ..... B63H 9/04

[52] U.S. Cl. ..... 114/39; 114/121; 114/125

[58] Field of Search ..... 114/121, 125, 315, 311, 114/39, 61; 405/186; 150/48, 49, 50; 224/153; 441/111; 244/151 R

[56] References Cited

U.S. PATENT DOCUMENTS

| | | | |
|---|---|---|---|
| 300,764 | 6/1884 | Collins | 114/311 |
| 1,145,953 | 7/1915 | Wheaton | 150/50 |
| 1,555,467 | 9/1925 | Graham | 150/48 |
| 2,536,682 | 1/1951 | Frieder et al. | 114/311 |
| 2,739,410 | 3/1956 | Budnick | 150/48 |
| 2,895,300 | 7/1959 | Hayward | 114/125 |
| 3,225,985 | 12/1965 | Romney | 224/153 |
| 3,735,598 | 5/1973 | Oeland, Jr. | 405/186 |
| 3,757,744 | 9/1973 | Pravaz | 244/151 R |
| 3,865,061 | 2/1975 | Newman | 114/61 |
| 4,011,824 | 3/1977 | Kaynor et al. | 114/121 |
| 4,047,255 | 9/1977 | Kiefer | 441/111 |
| 4,117,795 | 10/1978 | Ruiz | 114/39 |
| 4,244,485 | 1/1981 | Trammell | 150/49 |

FOREIGN PATENT DOCUMENTS

| | | | |
|---|---|---|---|
| 835878 | 6/1981 | U.S.S.R. | 114/121 |

OTHER PUBLICATIONS

UK Patent Application No. GB, 2117339, published Oct. 12, 1983, Rutten.

*Primary Examiner*—Trygve M. Blix
*Assistant Examiner*—Edwin L. Swinehart
*Attorney, Agent, or Firm*—Mason, Kolehmainen, Rathburn & Wyss

[57] ABSTRACT

A ballast apparatus for aiding in righting a capsized boat comprises a container for holding a quantity of water as ballast and includes a support for securing the container full of water to a person outwardly of the boat for exerting a righting moment thereon. The container is formed of flexible sheet material and is changeable between an opened condition for receiving and holding a quantity of water as ballast and a relatively flat collapsed condition for stowage while not in use on the boat.

8 Claims, 5 Drawing Figures

BALLAST APPARATUS FOR RIGHTING A CAPSIZED BOAT

BACKGROUND OF THE INVENTION

The present invention relates to a new and improved ballast apparatus for aiding in righting a capsized boat. More particularly, the ballast apparatus of the present invention is especially adapted for aiding a person in righting a capsized sailboat such as a sailing catamaran or multi-hull type power boat wherein a great amount of righting moment is required in order to restore the capsized hull to an upright position.

Modern catamaran sailboats and multi-hull power boats are generally difficult to right once they have capsized, especially if only one person is aboard. It is often very difficult when capsizing occurs for one person alone to return a capsized multi-hull boat to an upright condition.

OBJECTS OF THE INVENTION

It is an object of the present invention to provide a new and improved ballast apparatus for aiding in righting a capsized boat, and more particularly, a ballast apparatus especially designed for use in righting capsized catamaran sailboats and multi-hull power boats which are relatively difficult to return to the upright condition after capsizing.

It is another object of the present invention to provide a new and improved ballast apparatus of the character described which is formed of lightweight, flexible sheet material and is designed to be easily changed from a relatively flat collapsed condition for stowage while not in use to an open condition ready for receiving and holding a quantity of water used as ballast for aiding in righting the capsized hull.

Another object of the present invention is to provide a new and improved ballast apparatus of the character described wherein a support system is provided for securing the ballast container to the body of person outwardly of the boat hull so that along with the person's weight, the quantity of water contained in the ballast apparatus is helpful in exerting a sufficient righting moment on the boat hull to return the same to an upright condition.

Another object of the present invention is to provide a new and improved ballast apparatus which includes a stiffening element around the periphery of a bottom wall of the ballast container which tends to open up the side wall and submerge the lower end of the container so that the container can be easily filled with water.

Another object of the present invention is to provide a new and improved ballast apparatus of the character described which includes an upper stiffening ring which tends to spread open the upper end of the ballast container when deployed into a condition ready to receive water for ballast.

Yet another object of the present invention is to provide a new and improved ballast apparatus of the character described wherein an upper stiffening ring is provided tending to float for maintaining the upper end of the ballast container at a level above the sinking lower end in order to provide a rapid filling of the container with water to be used as ballast.

Still another object of the present invention is to provide a new and improved support for a ballast container of the character described which permits the container to be carried and supported from the shoulders of a person righting the boat and thereby provide additional ballast for exerting a righting moment on the capsized hull.

Yet another object of the present invention is to provide a new and improved ballast apparatus of the character described which is collapsible into a relatively small sized package which can be conveniently stowed away in a small space on the boat for use in emergencies when capsizing occurs.

Another object of the invention is to provide a new and improved ballast device of the character described which is low in cost, readily reusable, and which provides an additional safety capability for a person along on a boat.

BRIEF SUMMARY OF THE INVENTION

The foregoing and other objects and advantages of the present invention are accomplished in an illustrated embodiment thereof comprising a new and improved ballast apparatus for aiding in righting a capsized boat such as a sailing catamaran or multi-hull power boat. The ballast apparatus includes a container for holding a quantity of water as ballast and a support for securing the container of water to a person outwardly of the hull of the boat for providing a substantial additional righting moment for returning a capsized hull to an upright condition. The container is formed of fllexible sheet material and is changeable between an open condition ready for receiving and holding a quantity of water as ballast and a relatively flat collapsed condition for compact stowage on the boat while not in use.

BRIEF DESCRIPTION OF THE DRAWINGS

For better understanding of the present invention reference should be had to the following detailed description taken in conjunction with the drawings, in which.

BRIEF DESCRIPTION OF A PREFERRED EMBODIMENT

Figure 1:
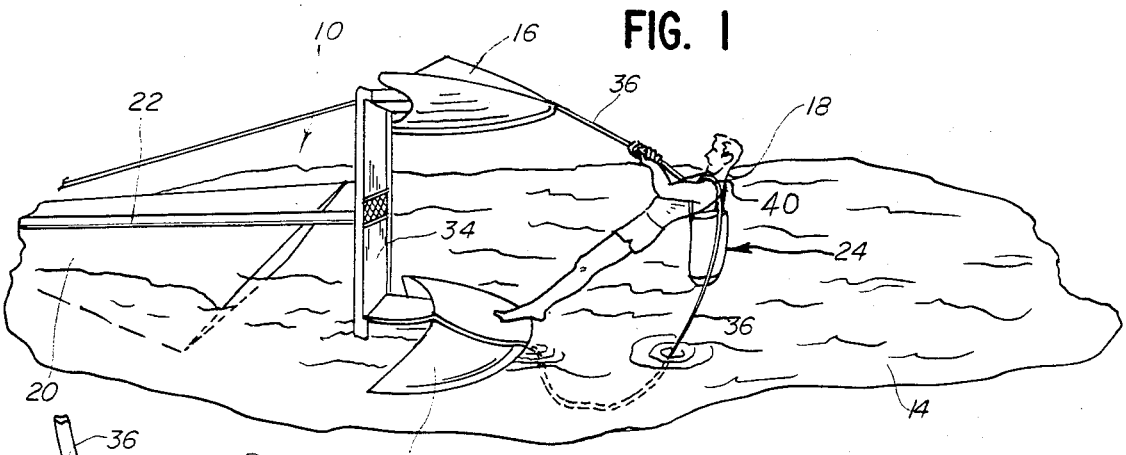
FIG. 1 is a perspective elevational view illustrating a new and improved ballast apparatus in accordance with the features of the present invention shown as it is used by a person attempting to right a capsized sailing catamaran.

Referring now more particularly to the drawings, in FIG. 1 is illustrated a typical catamaran type sailboat 10 shown in a capsized condition with one of the hulls 12 on its side in the water 14 and an opposite hull 16 positioned well above the level of the water. Many times after capsizing occurs, it is extremely difficult or impossible for sailor 18 alone to return the boat to an upright condition. On capsizing the sail 20 often becomes partially submerged or covered with water and the upper hull 16 moves past an overcenter position directly above the lower hull 12 in the water. When this happens the upper hull adds a counter moment in direct opposition to any righting effort that is exerted by a sailor for returning the boat to an upright sailing condition.

Should a boat turn completely turtle with the mast 22 pointing downwardly and both hulls 12 and 14 in the water it is extremely difficult, if not impossible, for a solo sailor 18 to return the boat to an upright sailing condition, and this may in many instances constitute an emergency condition if the boat cannot be returned to an operational condition after overturning.

In accordance with the present invention, a new and improved ballast apparatus 24 is especially designed for aiding in righting a capsized catamaran or multi-hull power boat and includes a container 26 formed of light weight, waterproof, flexible sheet material adapted to hold a quantity of water 28 of sufficient weight to provide a significant amount of righting moment when positioned outwardly of a water logged hull 12 of a capsized boat. The container is designed to be supported by the body of a person 18 as illustrated.

Figure 2:
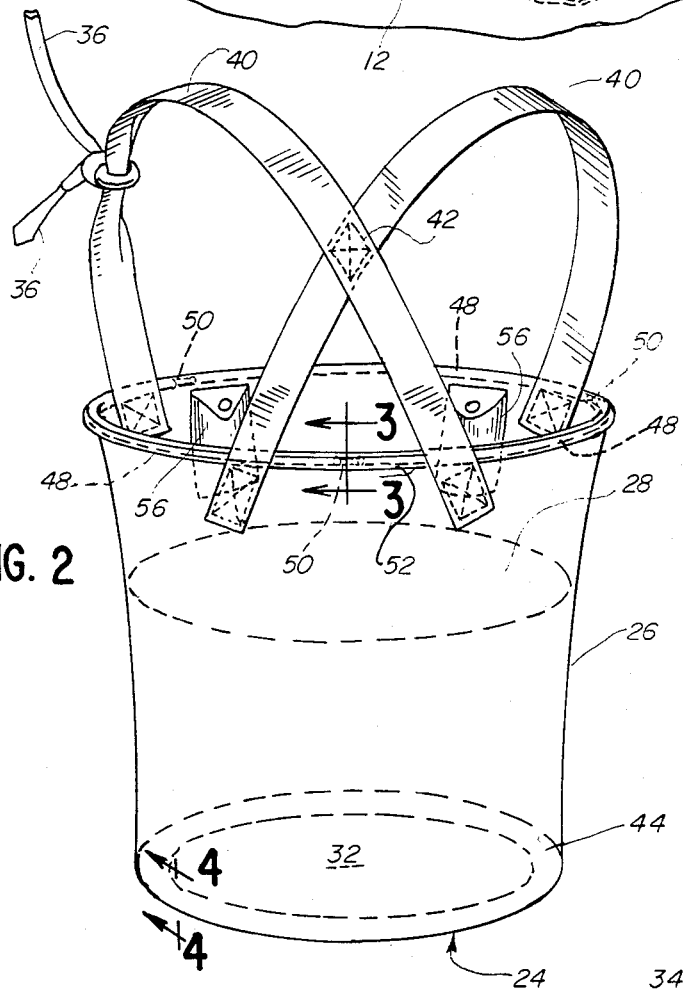
FIG. 2 is an enlarged perspective view of the ballast apparatus of the present invention shown in an open condition and containing a quantity of water as ballast.
Figure 3:
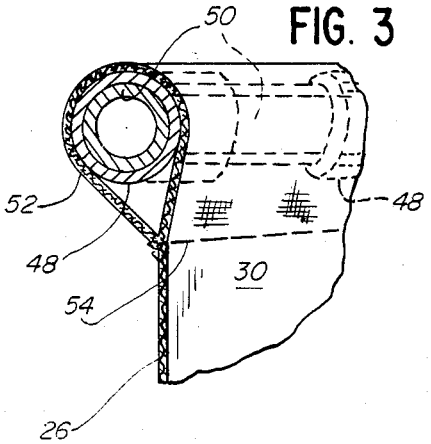
FIG. 3 is a fragmentary cross-sectional view taken substantially along lines 3—3 of FIG. 2.
Figure 4:
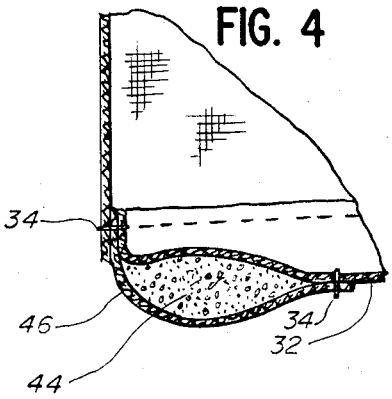
FIG. 4 is a fragmentary cross sectional view taken substantially along lines 4—4 of FIG. 2.

The flexible sheet material may comprise a vinyl film, polyester or other water impervious plastic sheet material of suitable thickness and toughness (4 mils for example) formed with a generally cylindrical sidewall 30 and a generally circular-shaped bottom wall 32 secured together around the periphery by heat sealing or stitching 34 to provide a water tight container when the ballast apparatus 24 is deployed to an open condition as shown in FIGS. 1 and 2 for containing a quantity of water 28 as ballast.

Figure 5:
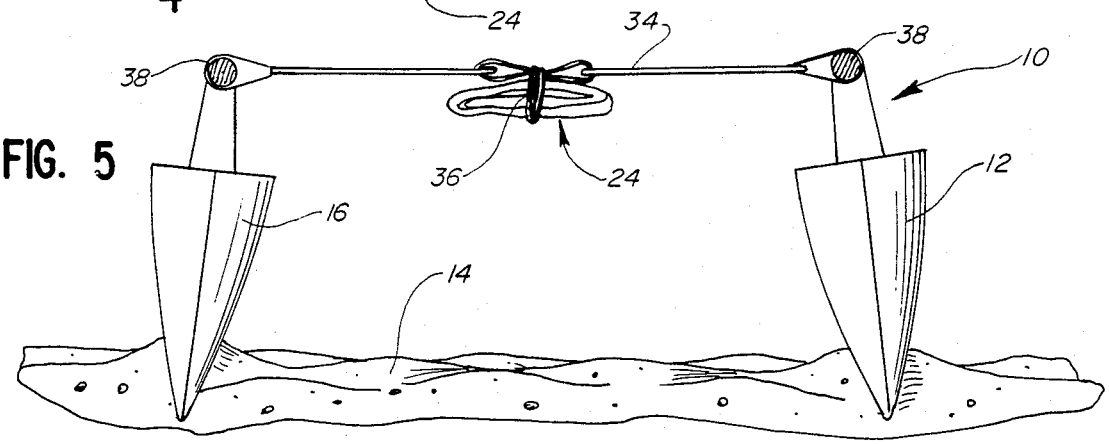
FIG. 5 is a transverse cross-sectional view taken through the hulls of a catamaran sailboat illustrating the ballast apparatus of the present invention in a collapsed, compact stowed condition and carried on the underside of the trampoline of the sailboat.

The apparatus 24 is changeable from a collapsed or compact stowed condition (as shown in FIG. 5) to a deployed open condition (FIGS. 1 & 2). In the compact condition, the container may be conveniently carried underneath a trampoline structure 34 of a sailboat and secured in the stowed position by an elongated, flexible, righting line 36 which is attached at opposite ends to side rails 38 which support the trampoline. The righting line 36 is also attached intermediate its ends to a shoulder strap 40 of a pair of straps formed of strong, flexible "Nylon" webbing or belting material. The shoulder straps are secured to the upper portion of the collapsible sidewall 26 of the container with stitching or other appropriate fastening means. As illustrated in FIG. 2, the shoulder straps 40 are criss-crossed and are fastened together at a point of crossing 42 with appropriate stitching.

In order to facilitate supporting the open container 24 from the sailor's shoulders, the straps 40 are spaced closer together at the lower ends on a back side of the sidewall of the container than the spacing at the forward side as best shown in FIG. 2. This arrangement enables a person to easily slip into the shouler straps 40 just before or after the open container 24 is deployed into the water and begins to fill with water for ballast. Once the container is filled, it is ready to use. As the person 18 with the shoulder strap in place (FIG. 1) begins to pull on the line and lift the container upwardly from the water level, a substantial increase in righting moment is developed. The water ballast 28 in the container 24 provides a substantial righting moment which is in addition to the righting moment provided by the body weight of the sailor. In both cases, the water ballast 28 and the body weight of the person 18 are acting through a substantial moment arm extending outwardly of the hull 12. Once the upper hull 16 passes the overcenter position during righting, a further increase in righting moment is provided. In most cases, even a relatively light weight person alone by using the ballast apparatus 24 can right a relatively large capsized sailboat such as catamaran 18 or 20 feet in length and without requiring help from other persons.

In accordance with the present invention when the ballast apparatus is deployed for use, the righting line 36 is loosened and the stowed ballast device 24 is dropped into the water. The opposite ends of the righting line 36 are already attached to the respective hulls 12 or 16 or side rails of the trampoline structure 34. Because the line 36 is released from the trampoline and no longer holds the ballast container 24 in the compact or folded up condition as shown in FIG. 5, the circular bottom wall 32 becomes free to open and begins to sink or submerge into the water.

The bottom wall is provided with a annular stiffening ring 44 formed by a continuous pocket around the outer edge containing sand or other particulate material that is denser than water. The sand is contained by a circular pouch wall 46 joined to the outer edge of the bottom wall and to the lower end of the side wall by heat sealing, stitching 34 or other appropriate means. The pouch wall is secured to the bottom wall inside the outer edge by similar stitching or heat sealing means. Because the sand is relatively dense, when the ballast apparatus 24 is deployed into the water 14, the heavy lower stiffening ring 44 gradually causes the bottom wall of the ballast container to sink or submerge slowly into the water. This action tends to open up the lower end portion of the generally cylindrical flexible sidewall 26.

At the upper end, the sidewall is provided with a collapsible stiffening ring formed by a plurality of elongated, hollow, arcuate-shaped, flexible tubular elements 48 formed of vinyl or rubber hose and these elements are cut to appropriate lengths less than the total circumference around the upper end of the sidewall so that the container may be folded tightly into a compact package when not in use. On deployment, the relatively stiff flexible hose elements tend to align end to end to form a continuous ring and this automatically opens the upper end of the flexible sidewall 26 into a generally circular shape to provide an open mouth ready for receiving water as the bottom wall begins to submerge. Adjacent ends of the hose elements 48 are flexibly and pivotally interconnected by short lengths of flexible tube or rod-like elements 50 which permit folding up of the ring but act as straightening devices to align the elements end to end so that when the ballast container 24 is deployed, the upper end of the sidewall 26 automatically opens into a circular ring.

Because the stiffening elements 48 and interconnecting tube or rod-like elements 50 are relatively light in weight, and because the tubular elements 48 are hollow and filled with air, the upper end portion of the sidewall 26 is supported by the upper stiffening ring and tends to float or stay near the surface of the water. This automatically aids in helping to extend the sidewall 26 downwardly from the compact folded condition so that a quantity of water 28 may fill rapidly into the container 24 and provide the necessary ballast. The upper stiffening ring elements 48 and 50 are contained in a pocket 52 formed around the upper edge of the sidewall 26 by stitching or other sealing means 54. The ballast apparatus 24 is also provided with one or more stowage pockets 56 adjacent an upper level on the inside surface of the collapsible sidewall 26 and these pockets provide means for holding emergency equipment or other items which may comprise a wide variety of types as may be selected and desired.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. Ballast apparatus for aiding in righting a capsized boat, comprising:

container means for holding a quantity of water as ballast, said container means being formed of flexible sheet material and changeable between an open condition for receiving and holding a quantity of water as ballast and a relatively flat, compact condition for stowage while not in use, said container means further including a collapsible sidewall adapted to open at an upper end and closed at a lower end by a bottom wall;

a stiffening element around a periphery of said bottom wall tending to open said sidewall around said bottom wall when said container means is deployed into the water, said stiffening element comprising a continuous pocket formed around a peripheral edge of said bottom wall containing flowable particulate material denser than water for submerging a lower end of said container means when deployed into the water, said container means further including stiffening ring means around said upper end of said sidewall ready to receive water for ballast when said container means is deployed in the water, said stiffening ring means comprising a plurality of relatively stiff, but flexible, hollow elongated elements aligned end to end forming a generally circular, floatable, hollow stiffener ring extending around said open end of said container, said hollow elongated elements comprising hollow tubes of flexible material pivotally interconnected together at adjacent ends thereof by elongated flexible elements projecting into the hollow interior thereof; and support means for securing said container of water to a person outwardly of said boat for exerting a righting moment thereon comprising shoulder strap means secured to said container means adjacent an upper level thereon for supporting the same from a persons shoulders.

2. The ballast apparatus of claim 1 wherein said shoulder strap means includes a pair of flexible straps secured at opposite ends to said container means adjacent an upper level thereof.

3. The ballast apparatus of claim 2 wherein said flexible straps are positioned to cross each other at a level above said container means.

4. The ballast apparatus of claim 3 wherein said flexible straps are secured to each other at a position of crossing.

5. The ballast apparatus of claim 4 wherein said flexible straps are of sufficient length to extend above said position of crossing over the shoulders of said person for supporting said container means.

6. The ballast apparatus of claim 5 wherein opposite ends of said shoulder straps are secured to said container means at a greater spacing therebetween on a forward portion than on a rearward portion.

7. The ballast apparatus of claim 1 wherein said support means includes an elongated flexible line having one end adapted to be secured to said boat and another end adapted to be secured to said shoulder strap means.

8. The ballast apparatus of claim 1 including one or more storage pockets provided on said sidewall of said container means.

* * * * *